US007828401B2

(12) United States Patent
Kobayashi

(10) Patent No.: US 7,828,401 B2
(45) **Date of Patent: *Nov. 9, 2010**

(54) RECORDING APPARATUS

(75) Inventor: Isao Kobayashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 230 days.

This patent is subject to a terminal disclaimer.

(21) Appl. No.: 11/456,013

(22) Filed: Jul. 6, 2006

(65) Prior Publication Data

US 2007/0008358 A1 Jan. 11, 2007

(30) Foreign Application Priority Data

Jul. 6, 2005 (JP) ..... 2005-197309

(51) Int. Cl.
*B41J 29/38* (2006.01)

(52) U.S. Cl. ..... 347/9; 347/43; 347/50

(58) Field of Classification Search ..... 347/5, 347/9–11, 57

See application file for complete search history.

(56) References Cited

U.S. PATENT DOCUMENTS 5,281,980 A 1/1994 Kishida et al.
7,101,007 B2 9/2006 Hayasaki
2002/0180815 A1 * 12/2002 Nou ..... 347/10
2003/0210288 A1 11/2003 Murata
2006/0103691 A1 * 5/2006 Dietl et al. ..... 347/40

FOREIGN PATENT DOCUMENTS

JP 2000158643 6/2000

OTHER PUBLICATIONS

Translation of JP 2000-158643 A.*
Human translation of JP 2000-158643 A.*

* cited by examiner

*Primary Examiner*—Matthew Luu
*Assistant Examiner*—Justin Seo
(74) *Attorney, Agent, or Firm*—Baker Botts L.L.P.

(57) ABSTRACT

A recording apparatus including: (a) recording heads for performing a dot recording operation using a recording material that is ejected by activation of actuators; (b) a main circuit for outputting drive waveform signal sets each of which controls ejection of the recording material from a corresponding one of the recording heads; and (c) a head driver unit for receiving the drive waveform signal sets outputted from the main circuit. The head driver has a drive-waveform-signal selector for selecting a drive waveform signal for each actuator of each recording head, from among a corresponding one of the received drive waveform signal sets. The drive-waveform-signal selector includes a common selector portion for making a selection from among one of the drive waveform signal sets that controls ejection of the recording material from one of the recording heads and also making a selection from among one of the drive waveform signal sets that controls ejection of the recording material from the other of the recording heads.

24 Claims, 9 Drawing Sheets

RECORDING APPARATUS

This application is based on Japanese Patent Application No. 2005-197309 filed on Jul. 6, 2005, the content of which is incorporated hereinto by reference.

BACKGROUND OF THE INVENTION

1. Field of the Invention

The present invention relates to a recording apparatus, for example, of inkjet type.

2. Discussion of Related Art

As a kind of recording apparatus, there is known an inkjet type recording apparatus for performing a recording operation. During the recording operation, and inkjet head unit is caused to eject recording materials (ink droplets) toward a recording medium, while a carriage carrying the head unit is moved such that the head unit is moved relative to the recording medium with a predetermined spacing distance therebetween being maintained.

As such an inkjet type recording apparatus, there is a recording apparatus in which a head driver unit mounted on the carriage is arranged to receive various data signals such as drive data signals (recording data signals) and drive waveform signals that are outputted from a main circuit disposed in a stationary main body of the apparatus. The inkjet head unit (hereinafter referred to as "recording head unit") is operated by the head driver unit, so as to eject the ink droplets through a plurality of nozzles formed in the head unit.

In the above-described recording apparatus, for performing a recording operation with graduation control, a plurality of drive waveform signals having respective different drive waveforms have to be available for each of the recording materials (different color inks), so that each recording material can be ejected as an ink droplet that is variable in its size. This arrangement results in increase of the number of signal wires required for supplying the drive waveform signals to the drive circuits of the head driver unit.

The increase of the number of the signal wires is disadvantageous in view of cost and maintenance performance. Particularly, where a flexible flat cable is used for transmitting the signals from the main circuit disposed in the stationary main body to the head driver unit carried by the carriage, the flexible flat wire has a width inevitably increased by the increased number of the signal wires, thereby necessitating a complicated disposition of the flexible flat cable and even increasing a load exerted on the carriage moved relative to the stationary main body.

In view of the above-described problems, there have been made various attempts to reduce the number of the signal wires for transmitting the drive waveform signals from the main circuit to the head driver unit. For example, there was proposed an arrangement, as disclosed in JP-2000-158643A, in which waveform-related data (e.g., data representative of pulse width) required for generation of drive waveform signals are serially transmitted to each of drive-waveform-signal generator circuits disposed in the recording head unit prior to a recording operation, and the drive waveform signals are generated based on the waveform-related data by the drive-waveform-signal generator circuits upon initiation of the recording operation.

In the above-described proposed arrangement, the number of the signal wires for transmitting the drive waveform signals from the main circuit to the head driver unit can be made smaller than in the conventional arrangement. However, the plurality of drive-waveform-signal generator circuits as extra components are required for the generations of the respective different drive waveform signals, whereby the recording head unit is inevitably increased in weight.

SUMMARY OF THE INVENTION

The present invention was made in view of the background prior art discussed above. It is therefore an object of the invention to provide a recording apparatus having an arrangement for making it possible to reduce the number of the signal wires used for transmitting the drive waveform signals from the main circuit to the head driver unit, without employing extra components such as drive-waveform-signal generator circuits.

This object may be achieved by the present invention providing a recording apparatus including: (a) a plurality of recording heads each of which has a plurality of actuators and each of which is operable to perform a dot recording operation using a recording material that is ejected by activation of the actuators; (b) a main circuit operable to output a plurality of drive waveform signal sets, each of which includes drive waveform signals having respective waveforms different from each other, and each of which controls ejection of the recording material from a corresponding one of the recording heads; and (c) a head driver unit operable to receive the drive waveform signal sets outputted from the main circuit, and having a drive-waveform-signal selector operable to select a drive waveform signal for each of the actuators of each of the recording heads, from among a corresponding one of the received drive waveform signal sets. The recording apparatus is selectively switchable between a first recording mode in which the dot recording operation is performed by a first recording head and a second recording mode in which the dot recording operation is performed by at least one second recording head, the first recording head being provided by one of the recording heads while the at least on second recording head being provided by the other of the recording heads. The drive-waveform-signal selector includes a common selector portion operable to make a selection from among one of the drive waveform signal sets that controls ejection of the recording material from the first recording head and also to make a selection from among one of the drive waveform signal sets that controls ejection of the recording material from one of the at least one second recording head. The head driver unit further has a selected drive-waveform-signal supplier which is operable when the recording apparatus is being placed in the first recording mode, to supply the drive waveform signal selected by the common selector portion from among the drive waveform signal set that controls ejection of the recording material from the first recording head, toward each of the actuators of the first recording head, and which is operable when the recording apparatus is being placed in the second recording mode, to supply the drive waveform signal selected by the common selector portion from among the drive waveform signal set that controls ejection of the recording material from the one of the at least one second recording head, toward each of the actuators of the one of the at least one second recording head.

The recording apparatus may be switched between the first and second recording modes, for example, by a mechanical or electrical switching device that is disposed in a main body of the apparatus (e.g., an operator panel) or in an external device (e.g., a personal computer) connected to the apparatus. Further, the apparatus may be switched between the first and second recording modes, for example, by a mode controller operable to determine in which one of the first and second recoding modes the apparatus should be placed, on the basis of drive data signals.

In the recording apparatus according to the invention, the drive-waveform-signal includes the common selector portion that is operable to make the selection from among the drive waveform signal set that controls ejection of the recording material from the first recording head and also to make the selection from among the drive waveform signal set that controls ejection of the recording material from one of the at least one second recording head. This arrangement with provision of the common selector portion is advantageous for reducing the number of the signal wires required for transmitting the drive waveform signal from the main circuit to the head driver unit. Further, the selected drive-waveform-signal supplier is provided on an output side of the common selector portion, for allowing supply of the drive waveform signal (selected from among the drive waveform signal se that control ejection of the recording material by the first recording head) toward each actuator of the first recording had during the first recording mode, and allowing supply of the drive waveform signal (selected by the common selector portion from among the drive waveform signal set that control ejection of the recording material by the one of the at least one second recording head) toward each actuator or the one of the at least one second recording head during the second recording mode. It is therefore possible to avoid an erroneous operation such as an erroneous supply of the selected drive waveform signal toward each actuator of the one of the at least one second recording head during the first recording mode and an erroneous supply of the selected drive waveform signal toward each actuator of the first recording head during the second recording mode.

BRIEF DESCRIPTION OF THE DRAWINGS

The above and other object, features, advantages and technical and industrial significance of the present invention will be better understood by reading the following detailed description of presently preferred embodiments of the invention, when considered in connection with the accompanying drawings, in which.

DETAILED DESCRIPTION OF THE PREFERRED EMBODIMENT

Referring first for FIGS. 1-6, there will be described a recording apparatus constructed according to an embodiment of the invention. This recording apparatus is of a known inkjet type, and includes a carriage reciprocatively movable along a recording medium, and a recording head unit mounted on the carriage and operable to eject ink droplets toward the recording medium.

Figure 1:
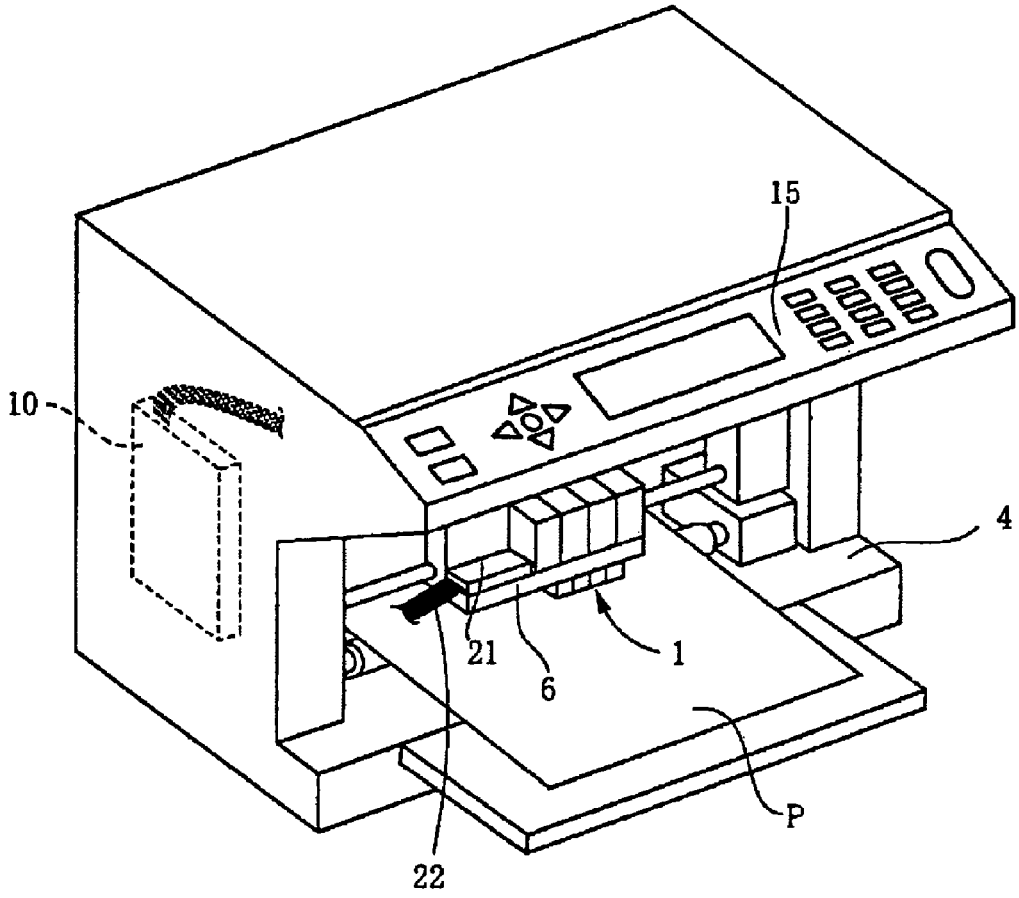
FIG. 1 is a perspective view of an inkjet-type recording apparatus constructed according to an embodiment of the invention.
Figure 2:
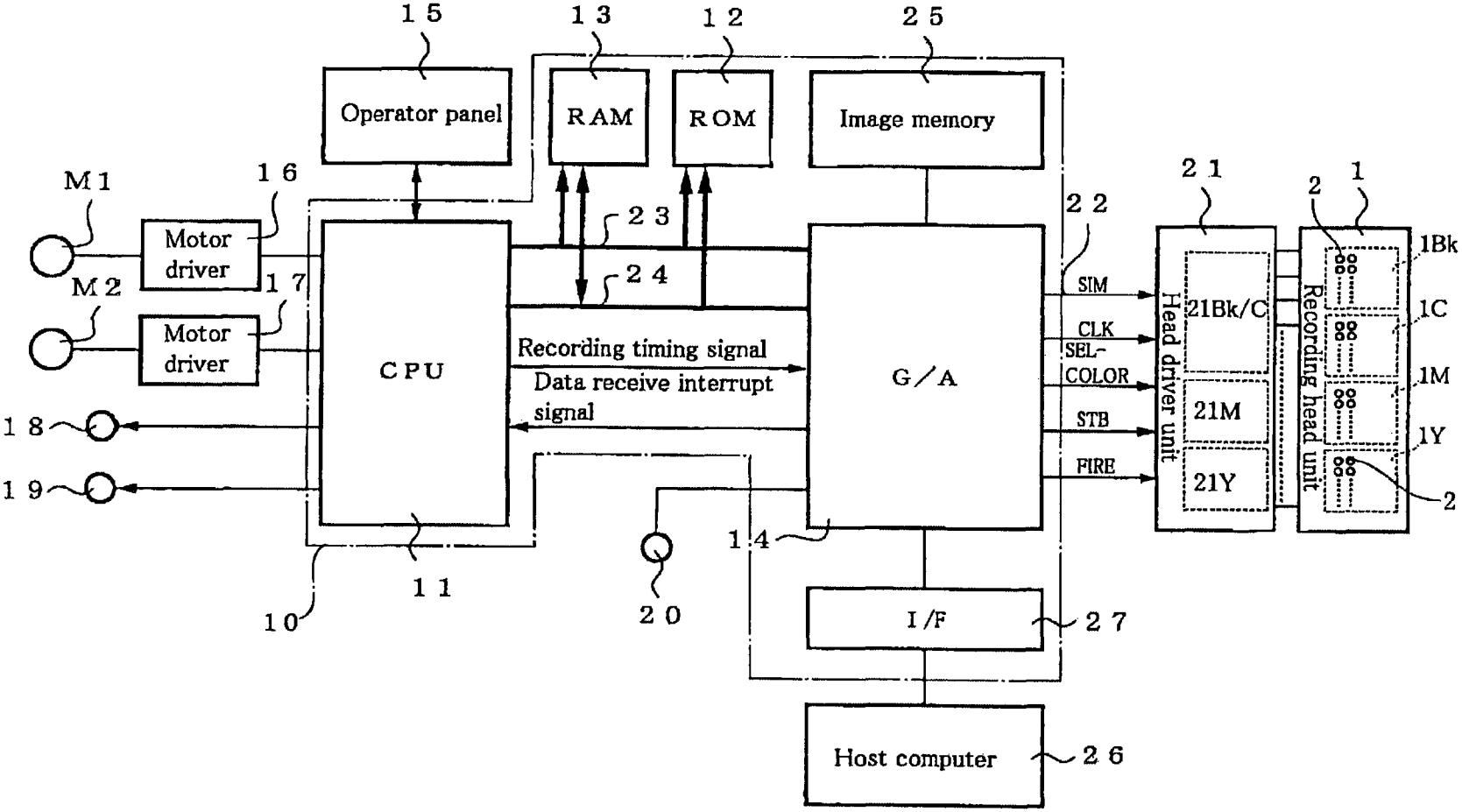
FIG. 2 is a block diagram showing an electrical arrangement in the recording apparatus of FIG. 1.

As shown in FIGS. 1 and 2, the recording apparatus has a controller principally constituted by a main circuit 10 that includes: CPU 11 for processing drive data signals (print data signals) and controlling operation of the recording apparatus; ROM 12 for storing programs executed by the CPU 11; RAM 13 for temporarily storing data during data during processing of the data signals by CPU 11; and a gate array (G/A) 14 provided by a gate circuit LSI. To the CPU 11; there are connected: an operator panel 15 through which the user renters desired commands (e.g., printing command) into the CPU 11; a motor driver 16 for driving a carriage motor M1 (for reciprocatively moving the carriage 6 relative to a stationary main body 4 of the recording apparatus); a motor driver 17 for driving a paper feed motor M2 (for feeding the recording medium in the form of a recording paper sheet P in a predetermined direction); a paper presence sensor 18 for detecting a leading edge of the paper sheet; and a home position sensor 19 for confirming that the carriage 6 carrying a recording head unit 1 is positioned in its home position when it is returned to the home position.

The recording head unit 1 includes four recording heads 1Bk, 1C, 1M, 1Y that are respectively operable to eject black, cyan, magenta and yellow inks as a plurality of recording materials. The recording head unit 1 is driven by a head driver unit 21 that is mounted together with the recording head unit 1 on the carriage 6. The head driver unit 21 and the gate array 14 are connected through a flexible flat cable 22 (harness cable), so that the head driver unit 21 is movable together with the carriage 6 while being controlled by the gate array 14.

Although not being specifically illustrated in the drawings, each of the recording heads 1Bk, 1C, 1M, 1Y of the recording head unit 1 has a plurality of actuators 2 each of which is provided by a piezoelectric element and an electrostriction element, a plurality of ink chambers (not shown) storing therein the inks, and a plurality of nozzles (not shown) held in communication with the respective ink chambers. The volumes of the respective ink chambers are changes (increased and reduced) independently of each other, by activations of the respective actuators 2. Thus, the ink in the form of an ink droplet is ejected through each nozzle when the volume of the corresponding ink chamber is changed. The actuators 2 are activated by the head driver unit 21 that is connected to electrodes provided in the recording head unit 1. The head driver unit 21 is a controlled by the gate array 14 to generated a drive signal having a waveform suitable for the recording head unit 1 and apply the generated drive signal to each of the electrodes. To the gate array 14, there is connected an encoder 20 that is arranged to detect a position of the carriage 6.

The CPU 11 is connected to the ROM 12, RAM 13 and gate array 14 via an address bus 23 and a data bus 24. The CPU 11 generates a recording timing signal and a reset signal in accordance with the programs prestored in the ROM 12, and transmits the signals to the gate array 14. Four drive waveform signal sets FIRE Bk 01~06, FIRE C 01~06, FIRE M 01~06, FIRE Y 01~06 are prestored in the ROM 12, or are transmitted together with the drive data signals from a host computer (personal computer) 26 via an interface 27 to the RAM 13 or an image memory 27 so as to be stored in the RAM 13 or image memory 27. The drive waveform signal sets stored in the ROM 12, RAM 13 or image memory 27 are supplied to the gate array 14, in a recording operation.

The gate array 14 received an image data transmitted from the host computer 26 as an external device via the interface 27, and supplies the data receive interrupt signal to the CPU 11.

The recording apparatus is selectively switchable between a first recording mode (monochrome mode) in which the recording operation is performed by the recording head 1Bk as a first recording head using the black ink, and a second recording mode (color mode) in which the recording operation is performed by the recording heads 1C, 1M, 1Y as second recording heads using no-black inks in the form of the cyan, magenta and yellow inks. The CPU 11 or the gate array 14 serves as a mode controller or mode selector operable to determine or select one of the above-described first and second recording modes by which the recording operation is to be performed, and output a mode selection signal SEL_COLOR representative of the selected recording mode. Where the mode selector is provided by the CPU 11, the CPU 11 selects one of the first and second recording modes, in accordance with the programs stored in the ROM 12. Where the mode selector is provided by the gate array 14, the gate array 14 selects one of the first and second recording modes, on the basis of the image data stored in the image memory 25. It is noted that the host computer 26 may be arranged to receive a mode-selection command signal and supply the mode-selection command signal to the recording apparatus, so that the CPU 11 or the gate array 14 determines or selects on of the first and second recording modes, in accordance with the supplied mode-selection command signal.

The gate array 14 generates a clock signal CLK and a strobe control signal STB, based on the recording timing signal and control signals supplied from the encoder 20, and generates drive data signals SIN_0, SIN_1, SIN_2 (for forming the image data on the recording medium), based on the image data temporarily stored in the image memory 25. The gate array 14 transmits the generated drive data signals SIN_0, SIN_1, SIN_2 in synchronization with the clock signal CLK, to the head driver unit 21. Further, the gate array 14 transmits, in response to the recording timing signals and the control signals supplied from the encoder 20, a total of four drive waveform signal sets FIRE Bk 01~06, FIRE C 01~06, FIRE M 01~06, FIRE Y 01~06, in synchronization with the clock signal CLK, to the head driver unit 21. The above-described mode selection signal SEL_COLOR is transmitted from the gate array 14 to the head driver unit 21, too. The transmissions of the signals from the gate array 14 to the head driver unit 21 are made through the flexible flat cable 22 that connects that gate array 14 and the head driver unit 21.

Figure 3:
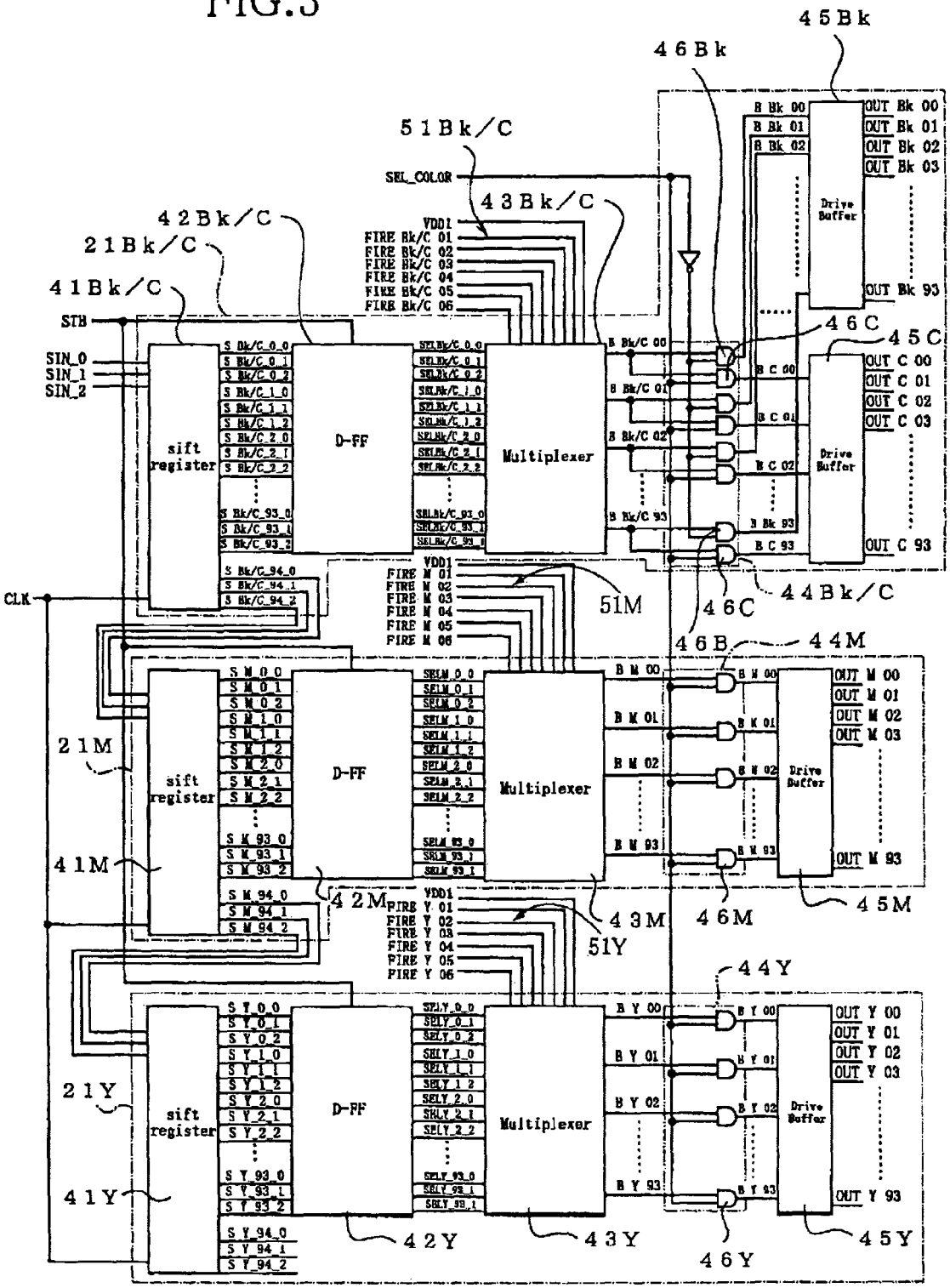
FIG. 3 is a block diagram showing a head driver unit of the recording apparatus of FIG. 1.

The head driver unit 21 has drive circuits 21Bk/C, 21M, 21Y, as shown in FIGS. 2 and 3. The recording heads 1Bk, 1C are driven by the drive circuit 21Bk/C as a common drive circuit, for ejecting the black and cyan inks, respectively. The recording head 1M is driven by the drive circuit 21M, for ejecting the magenta ink. The recording head 1Y is driven by the drive circuit 21Y, for ejecting the yellow ink.

The drive circuits 21Bk/C, 21M, 21Y have respective shift register 41Bk/C, 41M, 41Y as serial-parallel converters for converting the serially transmitted drive data signals SIN_0, SIN_1, SIN_2 into parallel data signals corresponding to the respective actuators. The drive circuits 21Bk/C, 21M, 21Y further have D flip-flops 42Bk/C, 42M, 42Y, multiplexers 43Bk/C, 43M, 43Y (that cooperate with each other to constitute a drive-waveform-signal selector) and selected drive-waveform-signal supplier 44Bk/C, 44M, 44Y. Each of the shift register 41Bk/C, 41M, 41Y, a corresponding one of the D flip-flops 42Bk/C, 42M, 42Y, a corresponding one of the multiplexers 43k/C, 43M, 43Y and a corresponding one of the selected drive-waveform-signal suppliers 44Bk/C, 44M, 44Y are arranged in the order of description, as shown in FIG. 3. The drive circuit 21Bk/C has two drive signal generators in the form of drive buffers 45Bk, 45C. The drive circuits 21M, 21Y have respective two drive signal generators in the form of drive buffers 45M, 45Y. The selected drive-waveform-signal supplier 44Bk/C supplies the signal to a selected one of the drive buffers 45Bk, 45C. That is, there is no case where the drivers 45Bk, 45C both receive the selected drive waveform signals.

Where the recording head unit 1 is provided by a 94 channel multi-nozzle head unit in which a total of 94 ink chambers are provided for each of the recording materials, each of the shift registers 41Bk/C, 41M, 41Y is provided by a shift register having a bit length of (94+1)×(the bit number of each drive data signal). The shift registers 41Bk/C, 41M, 41Y are arranged to receive the drive data signals SIN_0, SIN_1, SIN_2 that are serially transmitted from the gate array 14. The drive data signals SIN_0, SIN_1, SIN_2 are inputted in synchronization with the clock signal CLK, into the shift registers 41Bk/C, 41M, 41Y in the order of description. Last three bits S Bk/C94$_{13}$ 0, S BK/C94_1, S Bk/C94_2 of the shift register 41 Bk/C are output terminals connected to the shift register 41M. Last three bits S M94_0, S M94_1, S M94_2 of shift register 41M are output terminals connected to the shift register 41Y. Each of the shift registers 41Bk/C, 41M, 41Y is operated, upon a rising edge of each pulse of the clock signal CLK (i.e., upon a transition form a low voltage region to a high voltage region of the clock signal CLK), to convert each of the drive data signals SIN$_{13}$ 0, SIN_1, SIN_2 into parallel signals S Bk/C_*_0~2, S M_*_0~2, S Y_*_0~2 ("*" represents any one of numbers 0-93) serving as activator signals for activating the actuators 2 to change volumes of the respective ink chambers. Thus, each of the activator signals S Bk/C_*_0~2, S M_*_0~2, SY_*_0~2 is constituted by selection signal 3 bits, so that one of six drive waveform signals is selected from among the corresponding drive waveform signal set, based on a combination of the 3 bits.

Each of the D flip-flops 42Bk/C, 42M, 42Y is operated, upon a rising edge of each pulse of the strobe control signal STB transmitted from the gate array 14, to latch each of the activator signals parallelly transmitted thereto.

Each of the multiplexers 43Bk/C, 43M, 43Y is operated to select one of the six drive waveform signals from among a corresponding one of the drive waveform signal sets FIRE Bk_01~Bk_06, FIRE C_01~C_06, FIRE M_01~M_06, FIRE Y_01~Y_06, based on a content represented by the 3bit selection signal SEL Bk/C_*_0~2, SEL M_*_0~2, SEL Y_*_0~2 supplied from a corresponding one of the D flip-flops 42Bk/C, 42M, 42Y, and to supply the selected drive waveform signal to a corresponding one of the drive buffers 45Bk, 45C, 45M, 45Y.

In the present embodiment in which each drive waveform signal set is constituted by the six drive waveform signals, the six drive waveform signals have respective waveforms that are different from each other with respect to the number of pulses, and are repeatedly inputted to a corresponding one of the multiplexers 43Bk/C, 43M, 43Y at a constant cycle. Each of the multiplexers 43Bk/C, 43M, 43Y selects one of the six drive waveform signals, when receiving the 3-bit selection signal SEL Bk/C_*_0~2, SEL M_*_0~2, SEL Y_*_0~2 included in the activator signal. Specifically described, where the selection signal is 0, 0, 0, a non-recording (non-printing) is selected. Where the selection signal is 0, 1, 0, the drive waveform, signal; FIRE Bk_01, FIRE C_01, FIRE M_01 or FIRE Y_01 is selected. Where the selection signal is 0, 0, 1, the drive waveform signal FIRE Bk_02, FIRE C_02, FIRE M_02 or FIRE Y_02 is selected. Where the selection signal is 1, 0, 0, the drive waveform signal FIRE Bk_03, FIRE C_03, FIRE M_03 or FIRE Y_03 is selected. Thus, the ejection of the ink through each nozzle can be controlled in a total of seven levels of gradation (including a non-ejection).

Figure 4:
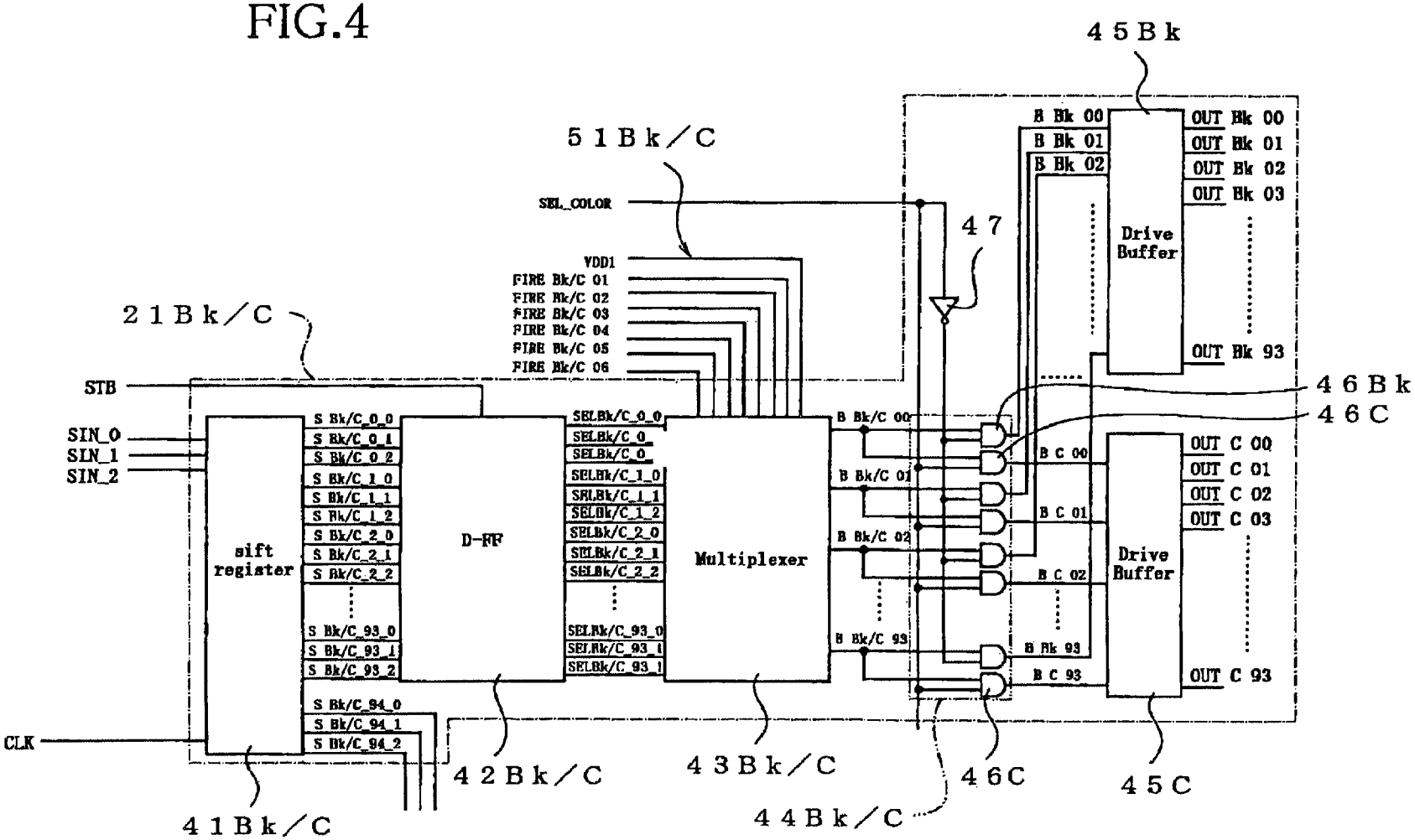
FIG. 4 is a block diagram showing a portion of the head driver unit shown in FIG. 3, which portion is assigned for ejection of black and cyan inks.

As shown in FIGS. 3 and 4, the selected drive-waveform-signal supplier 44Bk/C as a first selected drive-waveform-signal supplier has a plurality of first AND gates 46C and a plurality of second AND gates 46Bk. The first AND gates 46C are connected to the drive buffer 45C that is operable to generated the drive signal to each of the actuators 2 of the recording head 1C for ejecting the cyan ink. The first AND gates 46C are connected to the drive buffer 45C that is operable to generate the drive signal to each of the actuators 2 of the recording head 1C for ejecting the cyan ink, while the second AND gates 46Bk are connected to the drive buffer 45Bk that is operable to generate the drive signal to each of the actuators 2 of the recording head 1Bk for ejecting the black ink. Each of the first and second AND gates 46C, 46Bk is arranged to receive, as one of inputs thereto, the selected drive waveform signal B Bk/C * supplied from the multiplexer 43Bk/C. Further, each of the first AND gates 46C is arranged to receive, as another of the inputs thereto, the mode selection signal SEL_COLOR as such. Meanwhile, each of the second AND gates 46Bk is arranged to receive, as another of the inputs thereto, a complement of the mode selection signal SEL_COLOR through an inverter 47. In this arrangement, the selected drive waveform signal B Bk/C * is supplied as s signal B C * to the drive buffer 45C through the first AND gate 46C, when the mode selection signal SEL_COLOR is in its high ("1") level. The selected drive waveform signal B Bk/C * is supplied as a signal B Bk * to the drive buffer 45Bk through the second AND gate 46Bk, when the mode selection signal SEL_COLOR is in its low ("0") level.

As shown in FIG. 3, the selected drive-waveform-signal supplier 44M which servers as a second selected drive-waveform-signal supplier has a plurality of third AND gates 46M, while the selected drive-waveform-signal supplier 44Y which also serves as the second selected drive-waveform-signal supplier has a plurality of fourth AND gates 46Y. Each of the third AND gates 46M is arranged to receive the mode selection signal SEL_COLOR and also the selected drive waveform signal B M * supplied from the multiplexer 43M. Each of the fourth AND gates 46Y is arranged to receive the mode selection signal SEL_COLOR and also the selected drive waveform signal B Y * supplied from the multiplexer 43Y, In this arrangement, the selected drive waveform signal B M * is supplied to the drive buffer 45M through the third AND gate 46M, when the mode selection signal SEL_COLOR is in its high ("1") level. The selected drive waveform signal B Y * is supplied to the drive buffer 45Y through the fourth AND gate 46Y, when the mode selection signal SEL_COLOR is in its high ("1") level.

A shown in FIG. 3, each of the driver buffers 45Bk/C, 45M, 45Y is operated to generate, based on the selected drive waveform signal B Bk *, B C *, B M *, B Y * outputted from a corresponding one of the selected drive-waveform-signal suppliers 44Bk/C, 44M, 44Y, a drive signal OUT Bk *, OUT C *, OUT M *, OUT Y * having a predetermined voltage (suitable for the recording head unit 1) and a waveform corresponding to that of the outputted drive waveform signal and then supply the generated drive signal to each actuator 2 serving for the ejection of the ink from the corresponding nozzle.

To the multiplexer 43Bk/C as a common selector portion of the drive-waveform-signal selector, one of the drive waveform signal sets FIRE Bk 01~06, FIRE C 01~06, which is selected depending upon the selected recording mode, is inputted. To the multiplexers 43M, 43Y, the respective drive waveform signal sets FIRE M 01~06, FIRE Y 01~06 are inputted.

The drive waveform signal sets FIRE Bk 01~06, FIRE C 01~06 are transmitted to the multiplexer 43Bk/C through six common signal wires 51Bk/C. That is, one of the drive waveform signal sets FIRE Bk 01~06, FIRE C 01~06 that is selected depending upon the recording mode is transmitted to the multiplexer 43Bk/C through the common signal wires 51Bk/C. The waveform signal set FIRE M 01-06 is transmitted to the multiplexer 43M through six signal wires 51M. The waveform signal set FIRE Y 01~06 is transmitted to the multiplexer 43Y through six signal wires 51Y.

The gate array 14 serves as a drive-waveform-signal controller that is operable, when the recording apparatus is being placed in the first recording mode, to inhibit output of the drive waveform signal sets FIRE C 01~06, FIRE M 01~06, FIRE Y 01~06 for controlling ejection of non-black inks (cyan, magenta and yellow inks), namely, to inhibit the drive waveform signal sets FIRE C 01~06, FIRE M 01~06, FIRE Y 01~06 from being supplied to the multiplexers 43Bk/C, 43M, 43Y. Further, the gate array 14 as the drive-waveform-signal controller is operated, when the recording apparatus is being placed in the second recording mode, to inhibit output of the drive waveform signal set FIRE Bk 01~06 for controlling ejection of the black ink, namely, to inhibit the drive waveform signal set FIRE Bk 01~06 from being supplied to the multiplexer 43Bk/C.

That is, during the first recording mode, the common signal wired 51Bk/C are used as signal wired through which the drive waveform signal set FIRE Bk 01~06 is to be transmitted to the recording head 1Bk as the first recording head. During the second recording mode, the common signal wires 51Bk/ are used as signal wired through which the drive waveform signal set FIRE C 01~06 is to be transmitted to the recording head 1C as one of the second recording heads.

Figure 5:
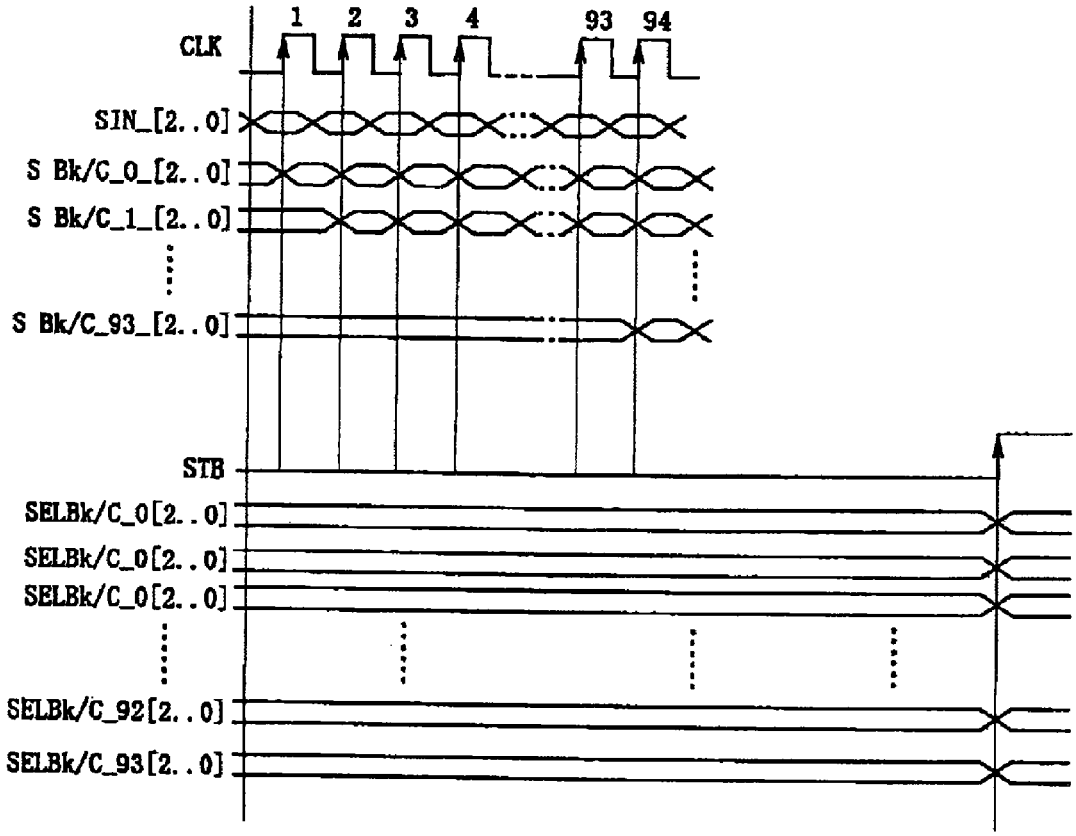
FIG. 5 is a timing chart showing an operation of the head driver unit during a first recording mode.

In the first recording mode (monochrome mode), as shown in FIG. 5, the drive data signals SIN_0, SIN_1, SIN_2 containing only drive data signals for the recording head 1Bk as the first recording head are supplied from the gate array 14 to the shift register 41Bk/C while the drive wave form signal set FIRE Bk 01~06 is supplied to the multiplexer 43Bk/C. Further, in the fist recording mode, the mode selection signal SEL_COLOR supplied to the selected drive-waveform-signal suppliers 44Bk/C, 44M, 44Y is held in its low ("0") level. Therefore, in the multiplexer 43k/C, one drive wave form signal for each channel of the recording head 1Bk is selected from among the FIRE Bk 01~06, based on the parallelly transmitted drive data signal S Bk_*_0~2. The selected drive waveform signal is supplied to the drive buffer 45Bk through the selected drive-waveform-signal supplier 44Bk/C, so that a monochrome recording is performed with activation of the recording head 1Bk. In the first recording mode, since the supplied drive data signals SIN_0, SIN_1, SIN_2 do not contain drive data signals for the other recording heads 1Bk, 1C, 1M, 1Y as the second recording heads, the shift registers 41Bk/C does not output the drive data signal S C *, and the shift registers 41M, 41Y do not output the drive data signals S M *, SY *. Thus, in the first recording mode, the multiplexers 43M, 43Y are not operated to make selection of the drive waveform signal.

Figure 6:
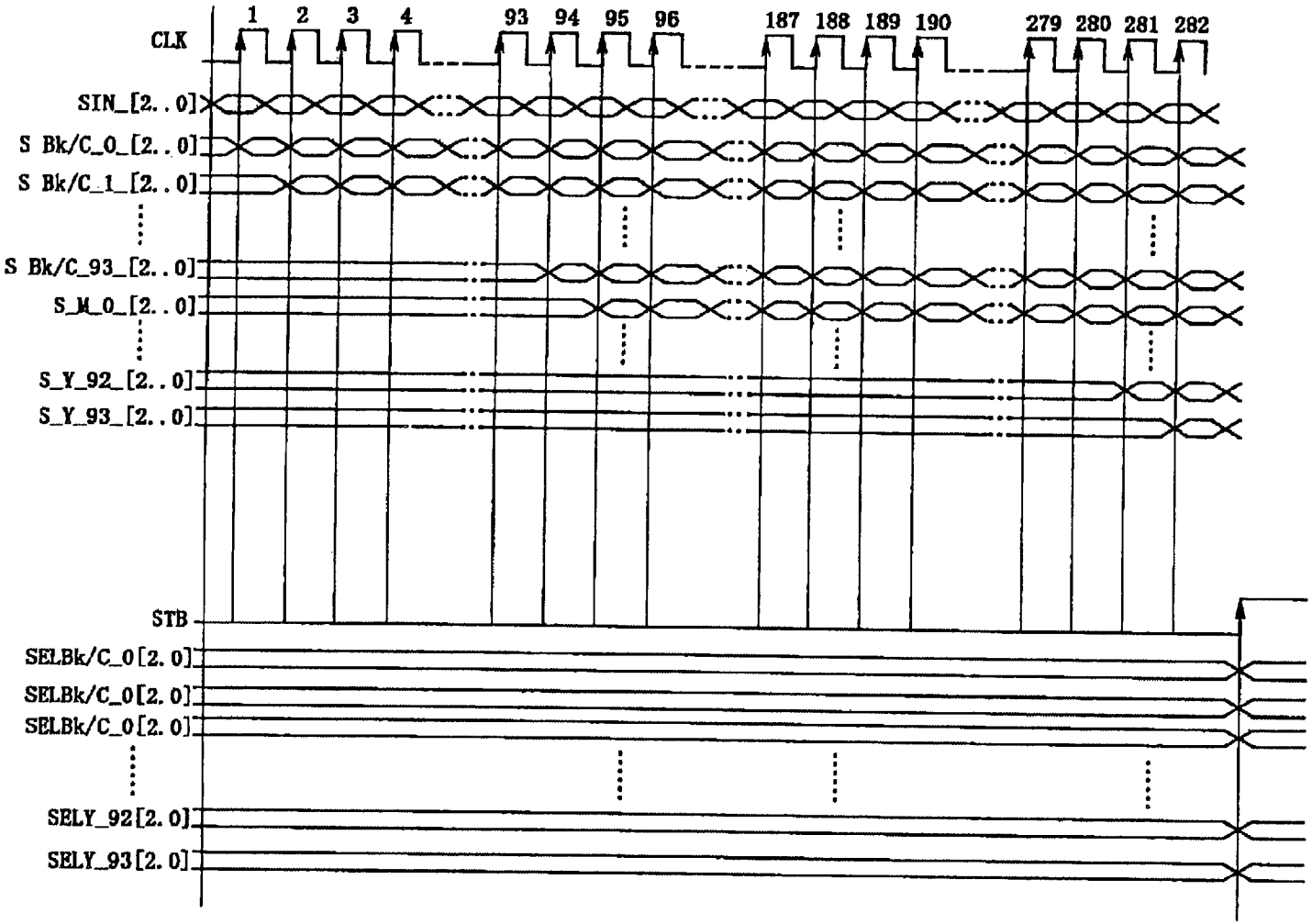
FIG. 6 is a timing chart showing an operation of the head driver unit during a second recording mode.

On the other hand, in the second recording mode (color mode), as shown in FIG. 6, the drive data signals SIN _0, SIN_1, SIN_2 containing only drive data signal for the recording heads 1C, 1Y, 1M as the second recoding heads are supplied from the gate array 14 to the shift registers 41Bk/C, 41M, 41Y, while the drive wave form signal sets FIRE C01~06, FIRE M01~06 are supplied to the multiplexers 43Bk/C, 43M, 43Y. Further, in the second recording mode, the mode selection signal SEL_COLOR supplied to the selected drive-waveform-signal suppliers 44Bk/C, 44M, 44Y, is held in its high ("1") level. Therefore, in the multiplexer 43Bk/C, one drive waveform signal for each channel of the recording head 1C is selected from among the FIRE C01~-6, based on the parallelly transmitted drive data signal S C_8_0~2. Meanwhile, in the multiplexer 43M, one drive waveform signal for each channel of the recoding head 1M is selected from among the FIRE M01~06, based on the parallelly transmitted drive data signal S M_8_0~2. In the multiplexer 43Y, one drive waveform signal for each channel of the recoding head 1Y is selected from among the FIRE Y01~06, based on the parallelly transmitted drive data signal S Y_*_0~2. The thus selected waveform signals are supplied to the drive buffers 45C, 45M, 45Y through the selected drive-waveform-signal suppliers 44Bk/C, 44M, 44Y, so that a color recording is performed with activation of the recording heads 1C, 1M, 1Y. In the second recording mode, a black color is expressed by a mixture of the cyan, magenta and yellow inks. Thus, since the drive data signals for the recording head 1Bk are not transmitted, an amount of the transmitted drive data signals can be made smaller than in an arrangement in which the drive data signals for all of the recording heads 1Bk, 1C, 1M 1Y are transmitted.

In each of the first and second recording modes, the recording operation with gradation control is performed by an ink droplet which is ejected though each nozzle and which has a volume variable according to the waveform (e.g., the number of drive pluses and the pulse width) of the drive waveform signal that is selected based on the activator signal (selection signal SEL Bk/C_*_0~2, SEL M_*_0~2, SEL Y_*_0~2).

While the recording condition remains unchanged, the drive waveform signals FIRE Bk 01~06, FIRE M 01~06, FIRE Y 01~06, FIRE C 01~06 are repeatedly read out by the gate array 14 at a constant cycle, and are repeatedly supplied as the drive waveform signals FIRE Bk/C 01~06, FIRE M 01~06, FIRE Y01~06, FIRE C 01~06 from the gate array 14 to the head driver unit 21.

In the above-described embodiment, each of the drive waveform signals FIRE Bk 01~06, FIRE C 01~06, FIRE M 01~06, FIRE Y 01~06 has a length corresponding to a recording cycle. The strobe control signal STB, which is inputted to the D flip-flops 42C, 42M, 42Y, 42Bk, has a cycle corresponding to the recording cycle.

In the recording apparatus of the above-described embodiment that is arranged to perform a color recording operation, the drive waveform signals transmitted to the head driver unit 21 are set to be suitable for characteristics of the respective inks (recording materials), In the above-described embodiment, the mode selector is provided by the CPU 11, gate array 14 or host computer 26. However, the mode selector may be provided also by an external switch that is operable to mechanically or electrically select one of the first and second recording modes. The external switch may be disposed, for example, on the operator panel 15 of the recording apparatus.

Figure 7:
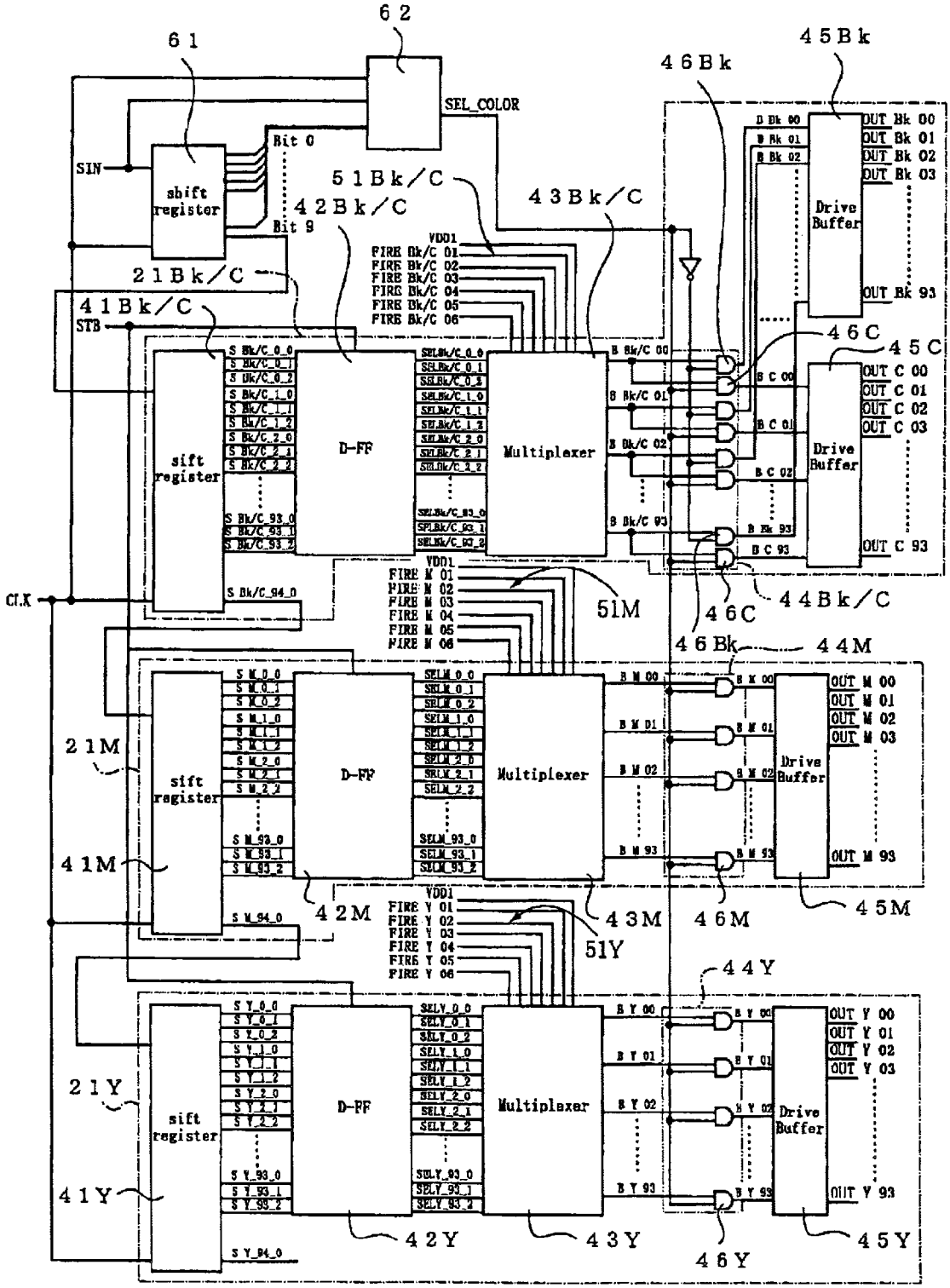
FIG. 7 is a block diagram showing a head driver unit of a recording apparatus constructed according to another embodiment of the invention.
Figure 8:
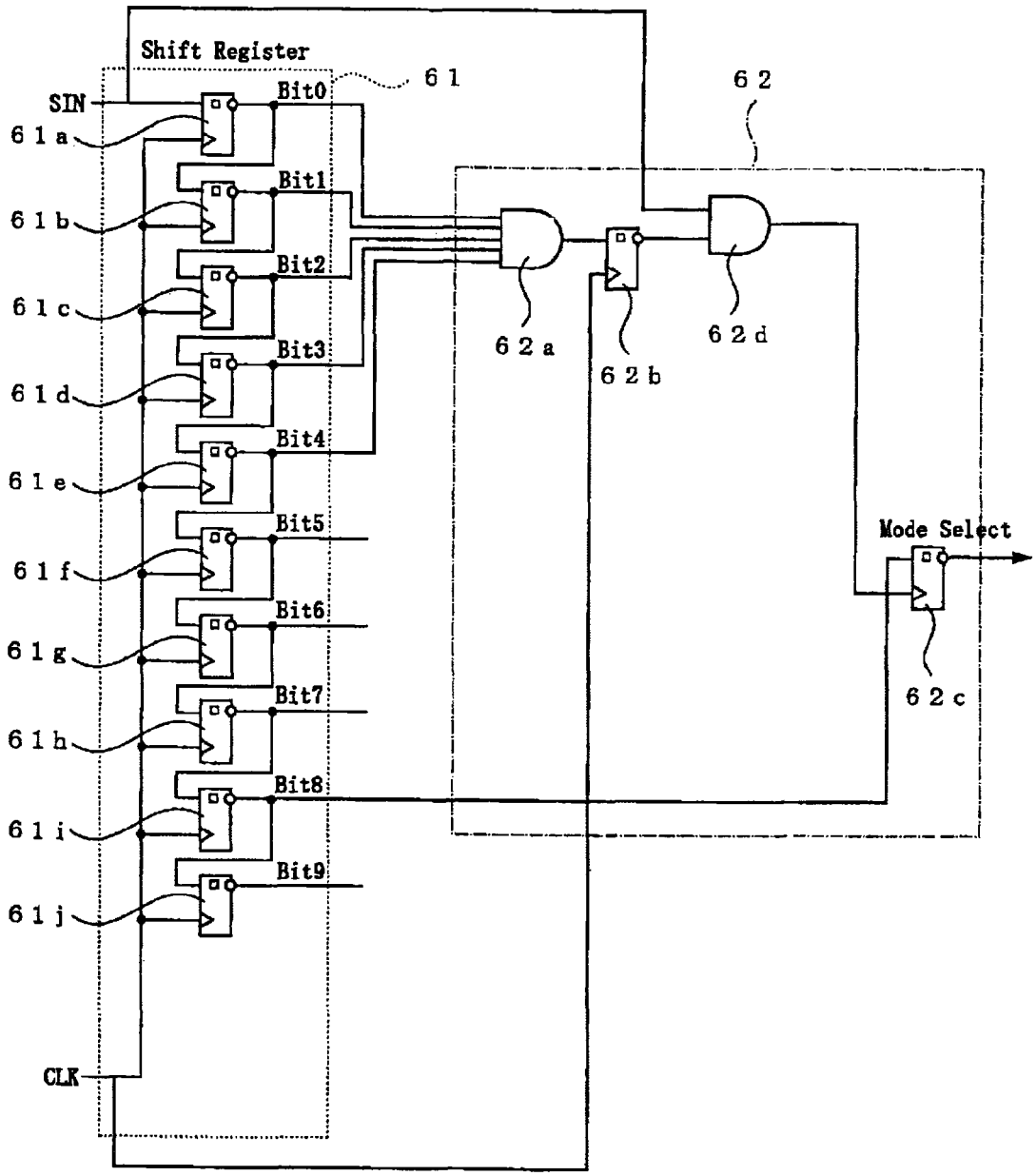
FIG. 8 is a view showing a block diagram showing a portion of the head driver unit of FIG. 7, which portion is assigned for generation of a mode selection signal.
Figure 9:
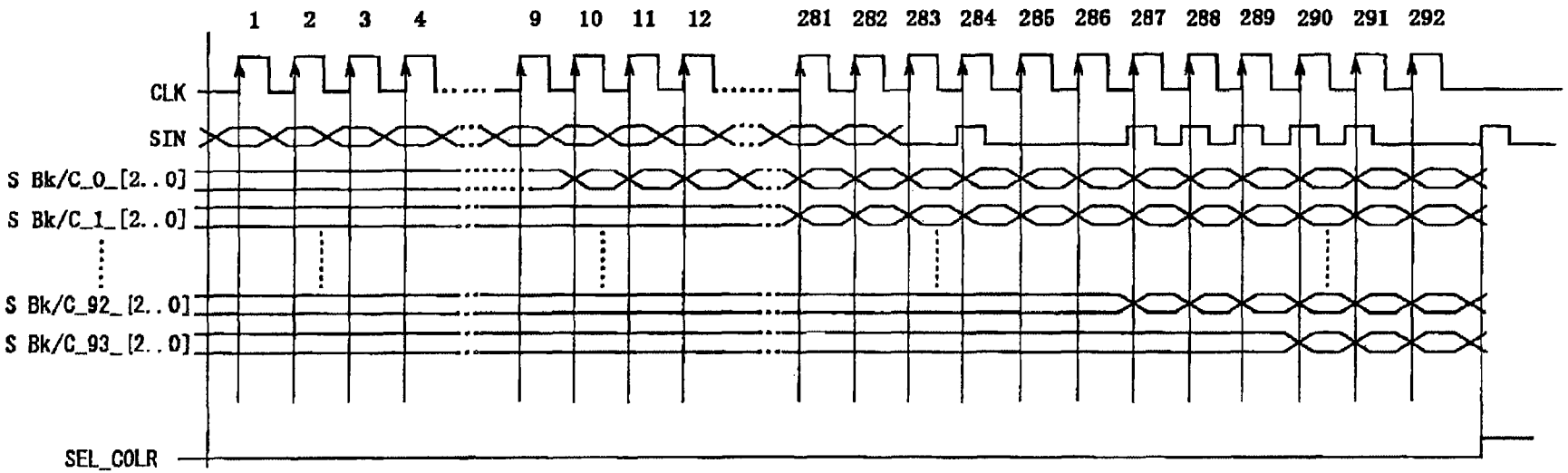
FIG. 9 is a timing chart showing an operation of the head driver unit of the recording apparatus constructed according to the another embodiment.

Referring next to FIG. 7-9, there will be described a recording apparatus constructed according to another embodiment of the invention. The same reference numerals as used in the above-described embodiment will be used to identify the same or similar elements, and redundant description of these elements will not be provided.

In the above-described embodiment, each of the activator signals (drive data signals) is constituted by a signal of 3 bits, so that one of six drive waveform signals is selected from among the corresponding drive waveform signal set, based on combinations of the 3 bits. In this case, the mode selection signal representative of the selected recording mode may be constituted by a combination of the 3 bits that is not used for the selection of the drive waveform signal. That is, in the above-described embodiment in which the ejection of the ink through each nozzle is controlled in a total of seven levels of gradation (including a non-ejection) by using seven of eight ($8=2^3$) combinations of the 3 bits, one remaining combination is available for the selection of the recording mode. Specifically, the combination (1, 1, 1) (That is not used for the selection of the drive waveform signal) can be used for the selection of the printing mode.

In the present embodiment shown in FIGS. 7-9, however, a plurality of bits are used exclusively for the selection of the recording mode. That is, bits constituting the drive data signal (activator signal) SIN includes at least one selection-data representation bit that represents a content of the selection data SEL (based on which the drive waveform signal is selected), and at least one recording-mode representation bit that represents apparatus is being placed. Specifically, a total of 9 bits are used for the selection of the recording mode in the present embodiment.

The CPU 11 or gate array 14 serving as the mode selector is operated to determine or select one of the first and second recording modes by which the recording operation is to be performed, and output the mode selection signal SEL_COLOR indicative of the selected recording mode. The mode selection signal SEL_COLOR is constituted by the 9 bits of the drive data signal SIN which are represented by (0, *, *, 1, 1, 1, 1, 1, 0) where the recording operation is to be performed by the first recording mode, and which are represented by (1, *, *, 1, 1, 1, 1, 1, 0) where the recording operation is to be performed by the second recording mode. The drive data signal SIN supplied from the gate array 14 is serially transmitted to a 10-bit shift register 61, before being transmitted to the shift registers 41Bk/C (see FIG. 7). To the 10-bit shift register 61 has a total of ten D flip-flops 61*a*-61*j*. The mode-selection signal generator 62 has a fifth AND gate 62*a* having five input terminals, D flip-flops 62*b*, 62*c*, and a sixth AND gate 62*d* having two input terminals (see FIG. 8). Among the ten D flip-flops 61*a*- 61*j* pf the 10-bit shift register 61, five D flip-flops 61*a*-61*e* are connected to the fifth AND gate 62*a*, so that outputs of the respective five D flip-lops 61*a*-61*e* are supplied to the fifth AND gate 62*a*. One of the ten D flip-flops 61*a*-61*j*, i.e., a D flip-flop 61*i* is connected to the D flip-flop 62*c*, so that output of the D flip-flop 61*i* is supplied to the D flip-flop 62*c*. Meanwhile, the other four D flip-flops 61*f*, 61*g*, 61*h*, 61*j* are connected neither to the fifth AND gate 62*a* nor to the D flip-flop 62*c*, so that outputs of the respective four D flip-flops 61*f*, 61*g*, 61*h*, 61*j* are supplied neither to the fifth AND gate 62*a* nor to the D flip-flop 62*c*.

FIG. 9 is a timing chart showing an operation of the head driver unit 21 of the recording apparatus according to the present embodiment. Specifically, the timing chart of FIG. 9 shows a stage in which the first recording mode (monochrome mode) is switched to the second recording mode (color mode) by the 9 bits of the drive data signal SIN which are represented by (1, *, *, 1, 1, 1, 1, 1, 0). The first bit represented by "1" is inputted to the D flip-flop 61*a* in synchronization with a pulse of the clock signal CLK that is numbered "284" in the timing chart of FIG. 9. When the eighth bit represented by "1" inputted to the D flip-flop 61*a* in synchronization with a pulse of the clock signal CLK that is numbered "291", the fourth through seventh bits each represented by "1" are inputted to the D flip-flops 61*e*-61*b*, respectively, so that an output of the firth AND gate 62*a* goes to "1" and an input of the D flip-flop 62*b* goes "1". Then, when a pulse of the clock signal CKL is inputted as another input to the D flip-flop 62*b*, an output of the D flip-flop 62*b* goes to "1" and an input of the sixth AND gate 62*d* goes to "1". Then, when the drive data signal SIN inputted as another input to the sixth AND gate 62*d* is placed in its high ("1") level (with the input of the sixth AND gate 62*d* remaining at "1"), an output of the sixth AND gate 62*d* goes to "1" and an input of the D flip-flop 62*c* goes to "1"Then, when an output of the D flip-flop 61*i* inputted as another input to the D flip-flop 62*c* is place in its high ("1"level, the D flip-flop 62*c* supplies its output in the form of the mode selection signal SEL_COLOR to one of two inputs of each of the AND gates 46Bk, 46C, 46M, 46Y (constituting the selected drive-waveform-signal suppliers 44Bk/C, 44M, 44Y) directly or via the inverter. The use of the large number of the bits, i.e. the 9 bits is advantageous for preventing an erroneous operation that could be caused by, for example, noises. After transmitting the above-described 9 bits, the gate array 14 transmits the other bits representative of data commanding the ejection of the recording material from each of the recording heads 1Bk, 1C, 1M, 1Y. The dive data signals SIN are serially transmitted through the last row of the shift register 61 to the shift register 41Bk/C, so that the subsequent operation of the head driver unit 21 is performed as in the above-described embodiment.

While the preferred embodiments of this invention have been described in detail, for illustrative purpose only, it is to be understood that the present invention is not limited to the details of the illustrated embodiments, but may be otherwise embodied.

In the above-described embodiments, the common signal wires 51Bk/C are arranged to transmit the drive waveform signal set FIRE Bk 01~06 controlling ejection of the black ink and also the drive waveform signal set FIRE C 01~06 controlling ejection of the cyan ink. However, the common signal wires may be arranged to transmit the drive waveform signal set FIRE M 01~06 or FIRE Y 01~06 in place of the drive waveform signal set FIRE C 01~06, in addition to the drive waveform signal set FIRE Bk 01~06.

In the above-described embodiments, the two drive waveform signal sets, which are selectively transmitted through the common signal tow wires to the drive circuits, are different from each other. However, where the two ink materials (one of which is used in the first recording mode and the other of which is used in the second recording mode) are similar to each other in characteristics, the drive waveform signal sets transmitted through the common signal wires may be identical with each other. In this case, the drive waveform signal sets transmitted through the common signal wires and identical with each other can be considered to be a single drive waveform signal set that is common to the two ink materials.

In the above-described embodiments, the four recording heads 1Bk, 1C, 1M, 1Y operable to eject the black, cyan, magenta and yellow inks, respectively, are provided by a single component in the form of the recording head unit 1. However the invention is applicable also to an arrangement in which the recording head portions 1C, 1M, 1Y, 1Bk are provided by respective recording head units independent from each other, rather than being provided by a single recording head unit.

While the recoding apparatus is of inkjet type in the above-described embodiments, the present invention is equally applicable to a recording apparatus of other type, for example, having an impact recording head or a thermal recording head.

In the above-described embodiments, each of the multiplexers 43Bk/C, 43M, 43Y is operated to select one of the drive waveform signals from among a corresponding one of the drive waveform signal sets FIRE Bk 01~06, FIRE C 01~06, FIRE M 01~06, FIRE Y 01~06, based on a desired level of gradation i.e., a desired degree of recording density (printing density) that is represented by the selection signal. However, the selection of the drive waveform signal may be made by a so-called "history control". Specifically, in the recording apparatus of impact type, the drive waveform signal selection may be made depending upon whether there is any drive data preceding or following the current drive data, so that the selection is made by taking account of vibration remaining in an impact element. In the recording apparatus of thermal type, the drive waveform signal selecting may be made depending upon whether there is any drive data preceding or following the current drive data, so that the selection is made by taking account of heat remaining in a heater element.

What is claimed is:

1. A recording apparatus comprising:

a plurality of recording heads each of which has a plurality of actuators and each of which is configured to perform a dot recording operation using a recording material that is ejected by activation of said actuators;

a main circuit configured to output a plurality of drive waveform signal sets, each of which includes drive waveform signals having respective waveforms different from each other, and each of which controls ejection of the recording material from a corresponding one of said recording heads; and a head driver unit configured to receive said drive waveform signal sets outputted from said main circuit, and having a drive-waveform-signal selector configured to select a drive waveform signal for each of said actuators of each of said recording heads, from among a corresponding one of the received drive waveform signal sets, wherein said recording apparatus is selectively switchable between a first recording mode in which the dot recording operation is performed by a first recording head as one of said recording heads and a second recording mode in which the dot recording operation is performed by a second recording head as one of said recording heads, wherein said drive-waveform-signal selector includes a common selector portion configured to make a selection from among a first drive waveform signal set as one of said drive waveform signal sets that controls ejection of the recording material from said first recording head and also to make a selection from among a second drive waveform signal set as one of said drive waveform signal sets that controls ejection of the recording material from said second recording head, wherein said common selector portion has a plurality of selected-drive-waveform-signal common output ports each of which is configured to be connected with a corresponding one of said actuators of said first recording head corresponding to said each of said selected-drive-waveform-signal common output ports and configured to be connected with a corresponding one of said actuators of said second recording head corresponding to said each of said selected-drive-waveform-signal common output ports, wherein said head driver unit further has a selected drive-waveform-signal supplier which is selectively switchable between a first supplying mode and a second supplying mode such that said selected drive-waveform-signal supplier is placed in said first supplying mode when said recording apparatus is being placed in said first recording mode, and such that said selected drive-waveform-signal supplier is placed in said second supplying mode when said recording apparatus is being placed in said second recording mode, wherein said selected drive-waveform-signal supplier is configured, when being placed in said first supplying mode, to supply the drive waveform signal selected from among said first drive waveform signal set, from said each of said selected-drive-waveform-signal common output ports, toward the corresponding one of said actuators of said first recording head, without supplying the drive waveform signal selected from among said second drive waveform signal set, from said each of said selected-drive-waveform-signal common output ports, toward the corresponding one of said actuators of said second recording head, and wherein said selected drive-waveform-signal supplier is configured, when being placed in said second supplying mode, to supply the drive waveform signal selected from among said second drive waveform signal set, from said each of said selected-drive-waveform-signal common output ports, toward the corresponding one of said actuators of said second recording head, without supplying the drive waveform signal selected from among said first drive waveform signal set, from said each of said selected-drive-waveform-signal common output ports, toward the corresponding one of said actuators of said first recording head.

2. The recording apparatus according to claim 1, wherein said head driver unit further has drive signal generators each configured to generate a drive signal and to supply the generated drive signal to each of said actuators of a corresponding one of said recording heads, wherein said selected drive-waveform-signal supplier of said head driver unit is configured, when said recording apparatus is being placed in said first recording mode, to supply the drive waveform signal selected from said first drive waveform signal set, to one of said drive signal generators as a first drive signal generator which supplies the drive signal to each of said actuators of said first recording head, said first drive signal generator generating the drive signal based on the drive waveform signal that is supplied by said selected drive-waveform-signal supplier when said recording apparatus is being placed in said first recording mode, and wherein said selected drive-waveform-signal supplier of said head driver unit is configured, when said recording apparatus is being placed in said second recording mode, to supply the drive waveform signal selected from said second drive waveform signal set, to one of said drive signal generators as a second drive signal generator which supplies the drive signal to each of said actuators of said second recording head, said second drive signal generator generating the drive signal based on the drive waveform signal that is supplied by said selected drive-waveform-signal supplier when said recording apparatus is being placed in said second recording mode.

3. The recording apparatus according to claim 1, wherein said main circuit is configured to output, in addition to said plurality of drive waveform signal sets, activator signals for activating said actuators, wherein said head driver unit is configured to receive said activator signals in addition to said drive waveform signal sets, and wherein said drive-waveform-signal selector of said head driver unit selects the drive waveform signal for each of said actuators, based on selection data contained in a corresponding one of the activator signals.

4. The recording apparatus according to claim 1, wherein said main circuit is connected to said head driver unit through a plurality of signal wires that transmit said drive waveform signal sets from said main circuit to said head driver unit, and wherein said signal wires include common signal wires which transmit said first drive waveform signal set that controls ejection of the recording material from said first recording head, and which transmit also said second drive waveform signal set that controls ejection of the recording material from said second recording head.

5. The recording apparatus according to claim 1, wherein said plurality of recording heads consists of said first and second recording heads and at least one third recording head that is other than said first and second recording heads, wherein said head driver unit has, in addition to said selected drive-waveform-signal supplier as a first selected drive-waveform-signal supplier, a second selected drive-waveform-signal supplier which is configured to supply the drive waveform signal selected from among the drive waveform signal set that controls ejection of the recording material from each of said at least one third recording head, toward each of said actuators of said each of said at least one third recording head.

6. The recording apparatus according to claim 1, wherein said main circuit has a drive-waveform-signal controller configured, when said recording apparatus is being placed in said first recording mode, to inhibit output of said second drive waveform signal set.

7. The recording apparatus according to claim 1, wherein said first recording head performs the dot recording operation using a black color material as the recording material, while each of said second recording head performs the dot recording operation using a non-black material as the recording material.

8. The recording apparatus according to claim 3, wherein each of said activator signals is constituted by a plurality of binary digits, and wherein said binary digits includes at least one selection-data representation bit that represents a content of said selection data, and at least one recording-mode representation bit that represents in which one of said first and second recording modes said recording apparatus is being placed.

9. The recording apparatus according to claim 1, further comprising:

a stationary main body in which said main circuit is fixedly disposed;

a carriage movable relative to said stationary main body, and carrying said recording heads and said head driver unit; and a flexible cable connecting said main circuit and said driver unit, and transmitting said drive waveform signal sets from said main circuit to said head driver unit.

10. The recording apparatus according to claim 2, wherein each of said recording heads has a plurality of ink chambers each of which stores therein an ink as the recording material, and wherein each of said actuators is activated by said drive signal, so as to change a volume of a corresponding one of said ink chambers, for ejecting the ink in the form of an ink droplet.

11. The recording apparatus according to claim 1, wherein said selected drive-waveform-signal supplier is configured, when being placed in said first supplying mode, to supply the drive waveform signal selected by said common selector portion solely from among said first drive waveform signal set, toward each of said actuators of said first recording head, and wherein said selected drive-waveform-signal supplier is configured, when being placed in said second supplying mode, to supply the drive waveform signal selected by said common selector portion solely from among said second drive-waveform-signal set, toward each of said actuators of said second recording head.

12. A recording apparatus comprising:

a plurality of recording heads each of which has a plurality of actuators and each of which is configured to perform a dot recording operation using a recording material that is ejected by activation of said actuators;

a main circuit configured to output a plurality of drive waveform signal sets, each of which includes drive waveform signals having respective waveforms different from each other, and each of which controls ejection of the recording material from a corresponding one of said recording heads; and a head driver unit configured to receive said drive waveform signal sets outputted from said main circuit, and having a drive-waveform-signal selector configured to select a drive waveform signal for each of said actuators of each of said recording heads, from among a corresponding one of the received drive waveform signal sets, wherein said recording apparatus is selectively switchable between a first recording mode and a second recording mode, such that the dot recording operation is performed by a first recording head as one of said recording heads when said recording apparatus is being placed in the first recording mode and such that the dot recording operation is performed by a second recording head as one of said recording heads when said recording apparatus is being placed in the second recording mode, wherein said drive-waveform-signal selector includes a common selector portion configured to make a selection from among a first drive waveform signal set as one of said drive waveform signal sets that controls ejection of the recording material from said first recording head and also to make a selection from among a second drive waveform signal set as one of said drive waveform signal sets that controls ejection of the recording material from said second recording head, wherein said head driver unit further has a selected drive-waveform-signal supplier which is configured to supply the drive waveform signal selected from among said first drive waveform signal set, toward each of said actuators of said first recording head, and which is configured to supply the drive waveform signal selected from among said second drive waveform signal set, toward each of said actuators of said second recording head, wherein said common selector portion has a plurality of selected-drive-waveform-signal common output ports each of which is configured to be connected with a corresponding one of said actuators of said first recording head corresponding to said each of said selected-drive-waveform-signal common output ports and configured to be connected with a corresponding one of said actuators of said second recording head corresponding to said each of said selected-drive-waveform-signal common output ports, wherein said selected drive-waveform-signal supplier includes a signal-supply destination selector, wherein said signal-supply destination selector is configured, when said recording apparatus is being placed in the first recording mode, to select said first recording head as a destination toward which the drive waveform signal selected from among said first waveform signal set is to be supplied from said each of said selected-drive-waveform-signal common output ports toward said corresponding one of said actuators of said first recording head, by connecting said each of said selected-drive-waveform-signal common output ports with said corresponding one of said actuators of said first recording head that is selected as said destination while disconnecting said each of said selected-drive-waveform-signal common output ports from said corresponding one of said actuators of the said second recording head, and wherein said signal-supply destination selector is configured, when said recording apparatus is being placed in the second recording mode, to select said second recording head as a destination toward which the drive waveform signal selected from among said second drive waveform signal set is to be supplied from said each of said selected-drive-waveform-signal common output ports toward said corresponding one of said actuators of said second recording head, by connecting said each of said selected-drive-waveform-signal common output ports with said corresponding one of said actuators of said second recording head that is selected as said destination while disconnecting said each of said selected-drive-waveform-signal common output ports from said corresponding one of said actuators of the said first recording head.

13. The recording apparatus according to claim 12, wherein said head driver unit further has drive signal generators each configured to generate a drive signal and to supply the generated drive signal to each of said actuators of a corresponding one of said recording heads, wherein said selected drive-waveform-signal supplier of said head driver unit is configured, when said recording apparatus is being placed in said first recording mode, to supply the drive waveform signal selected from said first drive waveform signal set, to one of said drive signal generators as a first drive signal generator which supplies the drive signal to each of said actuators of said first recording head, said first drive signal generator generating the drive signal based on the drive waveform signal that is supplied by said selected drive-waveform-signal supplier when said recording apparatus is being placed in said first recording mode, and wherein said selected drive-waveform-signal supplier of said head driver unit is configured, when said recording apparatus is being placed in said second recording mode, to supply the drive waveform signal selected from said second drive waveform signal set, to one of said drive signal generators as a second drive signal generator which supplies the drive signal to each of said actuators of said second recording head, said second drive signal generator generating the drive signal based on the drive waveform signal that is supplied by said selected drive-waveform-signal supplier when said recording apparatus is being placed in said second recording mode.

14. The recording apparatus according to claim 12, wherein said main circuit is configured to output, in addition to said plurality of drive waveform signal sets, activator signals for activating said actuators, wherein said head driver unit is configured to receive said activator signals in addition to said drive waveform signal sets, and wherein said drive-waveform-signal selector of said head driver unit selects the drive waveform signal for each of said actuators, based on selection data contained in a corresponding one of the activator signals.

15. The recording apparatus according to claim 12, wherein said main circuit is connected to said head driver unit through a plurality of signal wires that transmit said drive waveform signal sets from said main circuit to said head driver unit, and wherein said signal wires include common signal wires which transmit said first drive waveform signal set that controls ejection of the recording material from said first recording head, and which transmit also said second drive waveform signal set that controls ejection of the recording material from said second recording head.

16. The recording apparatus according to claim 12, wherein said plurality of recording heads consists of said first and second recording heads and at least one recording head that is other than said first and second recording heads, and wherein said head driver unit has, in addition to said selected drive-waveform-signal supplier as a first selected drive-waveform-signal supplier, a second selected drive-waveform-signal supplier which is configured to supply the drive waveform signal selected from among the drive waveform signal set that controls ejection of the recording material from each of said at least one recording head, toward each of said actuators of said each of said at least one recording head.

17. The recording apparatus according to claim 12, wherein said main circuit has a drive-waveform-signal controller configured, when said recording apparatus is being placed in said first recording mode, to inhibit output of said second drive waveform signal set that controls ejection of the recording material from said second recording head.

18. The recording apparatus according to claim 12, wherein said first recording head performs the dot recording operation using a black color material as the recording material, while said second recording head performs the dot recording operation using a non-black material as the recording material.

19. The recording apparatus according to claim 14, wherein each of said activator signals is constituted by a plurality of binary digits, and wherein said binary digits includes at least one selection-data representation bit that represents a content of said selection data, and at least one recording-mode representation bit that represents in which one of said first and second recording modes said recording apparatus is being placed.

20. The recording apparatus according to claim 12, further comprising:

a stationary main body in which said main circuit is fixedly disposed;

a carriage movable relative to said stationary main body, and carrying said recording heads and said head driver unit; and a flexible cable connecting said main circuit and said driver unit, and transmitting said drive waveform signal sets from said main circuit to said head driver unit.

21. The recording apparatus according to claim 13, wherein each of said recording heads has a plurality of ink chambers each of which stores therein an ink as the recording material, and wherein each of said actuators is activated by said drive signal, so as to change a volume of a corresponding one of said ink chambers, for ejecting the ink in the form of an ink droplet.

22. The recording apparatus according to claim 1, wherein a number of said plurality of selected-drive-waveform-signal common output ports of said common selector portion corresponds to a number of said actuators of said first recording head, and corresponds to a number of said actuators of said second recording head.

23. The recording apparatus according to claim 12, wherein a number of said plurality of selected-drive-waveform-signal common output ports of said common selector portion corresponds to a number of said actuators of said first recording head, and corresponds to a number of said actuators of said second recording head.

24. A recording apparatus comprising:

a plurality of recording heads each of which has a plurality of actuators and each of which is configured to perform a dot recording operation using a recording material that is ejected by activation of said actuators;

a main circuit configured to output a plurality of drive waveform signal sets, each of which includes drive waveform signals having respective waveforms different from each other, and each of which controls ejection of the recording material from a corresponding one of said recording heads; and a head driver unit configured to receive said drive waveform signal sets outputted from said main circuit, and having a drive-waveform-signal selector configured to select a drive waveform signal for each of said actuators of each of said recording heads, from among a corresponding one of the received drive waveform signal sets, wherein said recording apparatus is selectively switchable between a first recording mode in which the dot recording operation is performed by a first recording head as one of said recording heads and a second recording mode in which the dot recording operation is performed by a second recording head as one of said recording heads, wherein said drive-waveform-signal selector includes a common selector portion configured to make a selection from among a first drive waveform signal set as one of said drive waveform signal sets that controls ejection of the recording material from said first recording head and also to make a selection from among a second drive waveform signal set as one of said drive waveform signal sets that controls ejection of the recording material from said second recording head, wherein said head driver unit further has a selected drive-waveform-signal supplier which is selectively switchable between a first supplying mode and a second supplying mode such that said selected drive-waveform-signal supplier is placed in said first supplying mode when said recording apparatus is being placed in said first recording mode, and such that said selected drive-waveform-signal supplier is placed in said second supplying mode when said recording apparatus is being placed in said second recording mode, wherein said selected drive-waveform-signal supplier is configured, when being placed in said first supplying mode, to supply the drive waveform signal selected from among said first drive waveform signal set, toward each of said actuators of said first recording head, without supplying the drive waveform signal selected from among said second drive waveform signal set, toward each of said actuators of said second recording head, wherein said selected drive-waveform-signal supplier is configured, when being placed in said second supplying mode, to supply the drive waveform signal selected from among said second drive waveform signal set, toward each of said actuators of said second recording head, without supplying the drive waveform signal selected from among said first drive waveform signal set, toward each of said actuators of said first recording head, wherein said main circuit is connected to said head driver unit through a plurality of signal wires that transmit said drive waveform signal sets from said main circuit to said head driver unit, and wherein said signal wires include common signal wires each of which is, when said recording apparatus is being placed in said first recording mode, configured to transmit a corresponding one of said drive waveform signals included in said first drive waveform signal set that controls ejection of the recording material from said first recording head, and each of which is, when said recording apparatus is being placed in said second recording mode, configured to transmit a corresponding one of said drive waveform signals included in said second drive waveform signal set that controls ejection of the recording material from said second recording head.

* * * * *